US006520816B1

(12) United States Patent
Hu

(10) Patent No.: US 6,520,816 B1
(45) Date of Patent: Feb. 18, 2003

(54) DIVING FINS

(76) Inventor: Chia-Te Hu, 4F, No. 16, Lane 216, How-Gaang St., Taipei (TW)

( * ) Notice: Subject to any disclaimer, the term of this patent is extended or adjusted under 35 U.S.C. 154(b) by 0 days.

(21) Appl. No.: 10/118,999

(22) Filed: Apr. 10, 2002

(51) Int. Cl.[7] ..... A63B 31/08
(52) U.S. Cl. ..... 441/64
(58) Field of Search ..... 441/61, 63, 64; D21/806

(56) References Cited

U.S. PATENT DOCUMENTS

| | | | | | |
|---|---|---|---|---|---|
| 802,306 | A | * | 10/1905 | McKittrick | 441/61 |
| 3,005,025 | A | * | 10/1961 | Ferraro et al. | 552/206 |
| 3,422,470 | A | * | 1/1969 | Mares | 441/64 |
| 6,120,336 | A | * | 9/2000 | Kawai et al. | 441/64 |
| 6,126,503 | A | * | 10/2000 | Viale et al. | 441/64 |
| 6,394,863 | B1 | * | 5/2002 | Chen | 441/64 |

* cited by examiner

*Primary Examiner*—S. Joseph Morano
*Assistant Examiner*—Andrew Wright
(74) *Attorney, Agent, or Firm*—Rosenberg, Klein & Lee

(57) ABSTRACT

Improved diving fins in which a flexile second web surface is disposed at the approximate center portion of a longitudinal web section. As such, when the diver articulates both legs rearward and downward for aquatic kicking by posterior extension, the second web surface is automatically displaced forward by the force of water resistance and then reverts to a nearly perpendicular angle as the rigidness of the first web surface follows in coordination during the kicking sequence, with the power articulated by the legs not only capable of kicking efficiency that produces a maximum reactive force (thrust) and increases diver speed, but at the same time also allows for a reduction in kick rate and effectively delays the onset of diver fatigue. When the diver articulates both legs forward and upward preparatory for aquatic kicking by anterior bending, since the second web surface is automatically displaced rearward by the force of water resistance and a diverting hole provides for the passage of water flow, viscous drag is effectively reduced and enables the saving of strength.

1 Claim, 5 Drawing Sheets

DIVING FINS

BACKGROUND OF THE INVENTION

1) Field of the Invention

The invention herein relates to improved diving fins.

2) Description of the Prior Art

The typical structure and operational details of a conventional pair of diving fins are shown in FIG. 1, wherein the longitudinal fin surface 10 of the said fins 1 is comprised of a single web section 102 disposed between fluke sections 101 along two sides. When the diver executes the posterior extension and anterior bending of both legs (conventionally consisting of an alternating upward and downward fluttering action), the two said fluke sections 101 directly support the web section 102 during the aquatic kicking sequence and enables the objective of diver mobility. Undeniably, the single web section 102 of the conventional fins that enables aquatic kicking propulsion possesses practical value and provides functional performance and, furthermore, is currently in widespread use among a majority of divers. However, the inventor of the invention herein discovered several shortcomings that were observed over a period of long-term utilization, each of which can be feasibly improved.

1. To reinforce the web section 102 during aquatic kicking, specifically against contortion due to water drag that results in an incapability to generate thrust, the two fluke sections 101 supporting the web section 102 must be of a relatively hard composition such that when the diver articulates both legs into posterior extension for aquatic kicking and the greater active extent of the fin surface 10 is an inclined disposition, the fin surface 10 and the two fluke sections 101 with which it is formed as a single structural entity and, furthermore, the rigidly configured longitudinal web section 102 must also be in an inclined disposition such that water is kicked at an oblique angle. However, as is well-known by all, the angle at which the said web section 102 generates maximum aquatic kicking efficiency is one that is perpendicular to the traveling direction of the diver. Given the oblique angle of aquatic kicking attack of the said web section 102, the reactive force (i.e., thrust) generated is not proportional to the aquatic kicking power delivered by the diver and results in less than optimal aquatic kicking efficiency.

2. As per the said shortcoming, since the fin surface 10 is in an inclined disposition, the said web surface 102 is accordingly at an oblique angle during aquatic kicking and consequently cannot provide a reactive force (thrust) that is proportional to the aquatic kicking power applied, therefore, to maintain underwater traveling speed, the diver must increase the rate of aquatic kicking, which obviously results in the drawbacks of a greater dissipation of physical strength and an easier onset of fatigue.

3. Since the said planar longitudinal web section 102 and the relatively hard fluke sections 101 are formed as a single structural entity that is rigidly configured, when the diver articulates both legs forward and upward preparatory to aquatic kicking by anterior bending, the forward and upward flexing of the planar web section 102 encounters relatively high fluid drag and, as such, the obvious shortcomings affecting diver articulation are the need use more strength and an inability to effectively increase speed.

4. Since the said two fluke sections 101 are relatively hard constructs, they are capable of supporting the single, large surface area of the web section 102 during the articulation of both legs during aquatic kicking. However, the relatively hard composition of the said fluke sections 101 obviously affects the degree of pliability of the fin surface 10, which in turn influences the degree of agility and control, resulting in stiffness and lack of smoothness.

As conveyed above, the structure of said conventional diving fins has several shortcomings that are manifested during actual utilization and, furthermore, require improvement.

SUMMARY OF THE INVENTION

The primary objective of the invention herein is to provide improved diving fins, wherein a flexile second web surface is disposed at the approximate center portion of a longitudinal web section. As such, when the diver articulates both legs rearward and downward for aquatic kicking by posterior extension, the said second web surface is automatically displaced forward by the force of water resistance and then reverts to a nearly perpendicular angle as the rigidness of a first web surface follows in coordination during the kicking sequence, with the power articulated by the legs not only capable of kicking efficiency that produces a maximum reactive force (thrust) and increases diver speed, but at the same time also allows for a reduction in kick rate, thereby conserving physical strength and delaying the onset of fatigue.

Another objective of the invention herein is to provide improved diving fins, wherein when the diver articulates both legs forward and upward preparatory to the next aquatic kick by anterior bending, since the said second web surface is automatically displaced rearward by the force of water resistance and a diverting hole provides for the passage of water flow, viscous drag is effectively reduced and enables the saving of strength.

Yet another objective of the invention herein is to provide improved diving fins, wherein the second web surface of the said web section is capable of flexing forward in coordination with the first web surface when both legs are articulated into posterior extension to produce optimal efficiency during the aquatic kicking sequence and, furthermore, capable of flexing rearward when both legs are articulated into anterior bending to effectively reduce viscous drag encountered preparatory to the next aquatic kick. Consequently, the fluke sections disposed along the two sides of the web section can be of a softer composition, enabling the fin surface of the fins have a greater degree of pliability such that aquatic kicking articulation and control is more agile and natural.

Still another objective of the invention herein is to provide improved diving fins that are simple and convenient in terms of structure, fabrication, and utilization and which allows the diver to enjoy efficient strength conservation and higher speed performance while articulating both legs in the process of aquatic kicking. As such, the present invention meets the requirements of actual utilization, is ideal and progressive and, furthermore, the said improved diving fins are unprecedented.

DETAILED DESCRIPTION OF THE INVENTION

Figure 1:
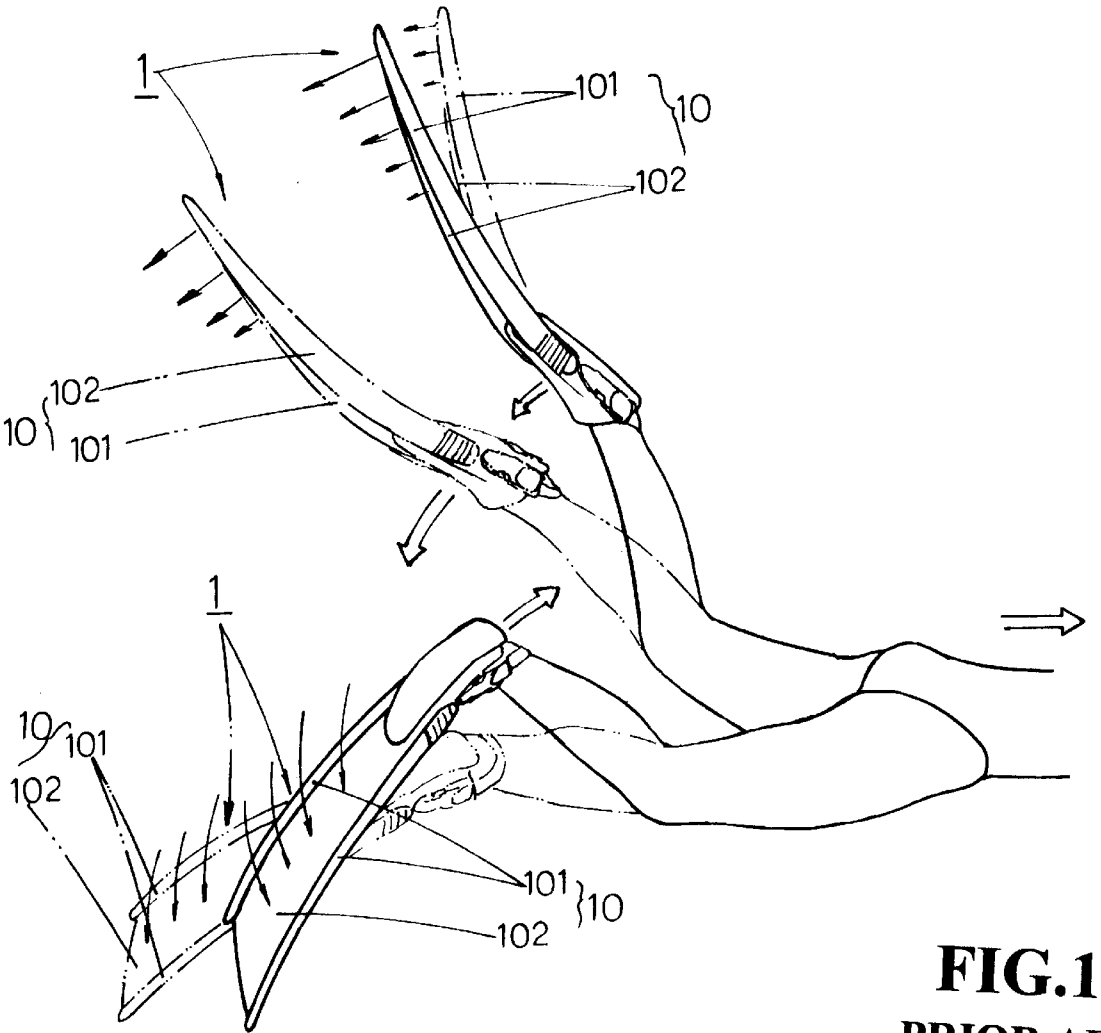
FIG.1 PRIOR ART
FIG. 1 is an isometric drawing of conventional diving fins.
Figure 2:
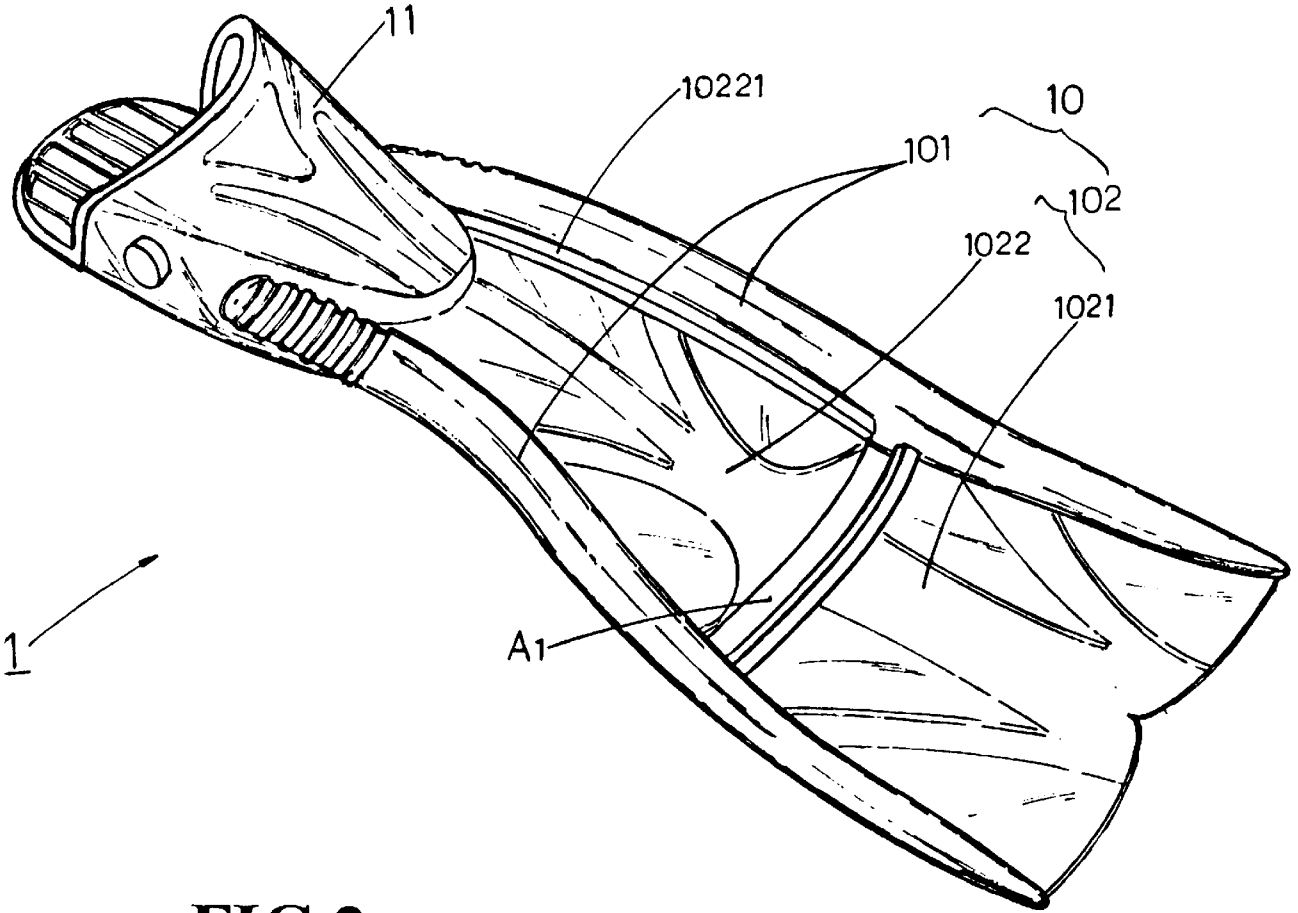
FIG. 2 is an isometric drawing of the invention herein.
Figure 3:
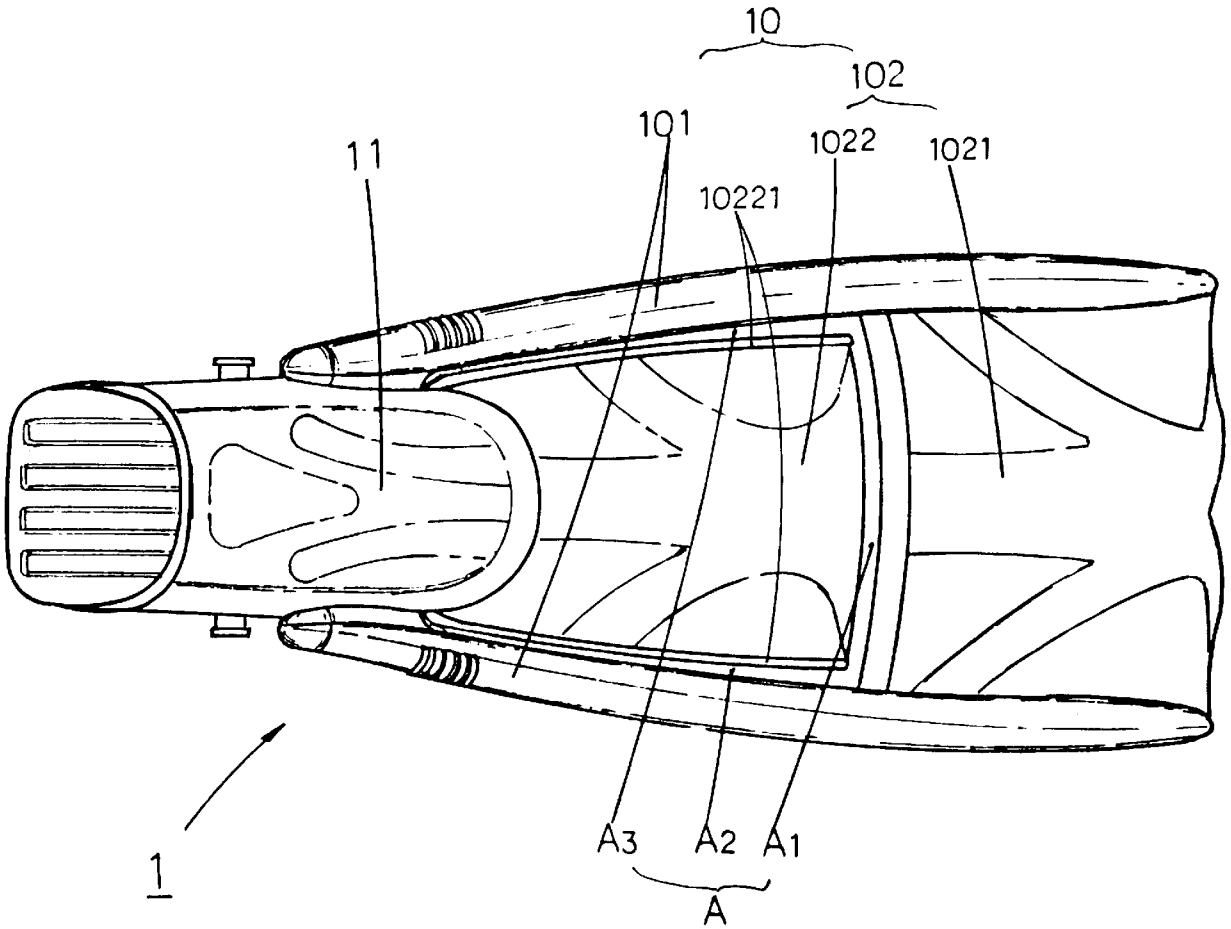
FIG. 3 is an orthographic drawing of the invention herein, as viewed from a top perspective.
Figure 4:
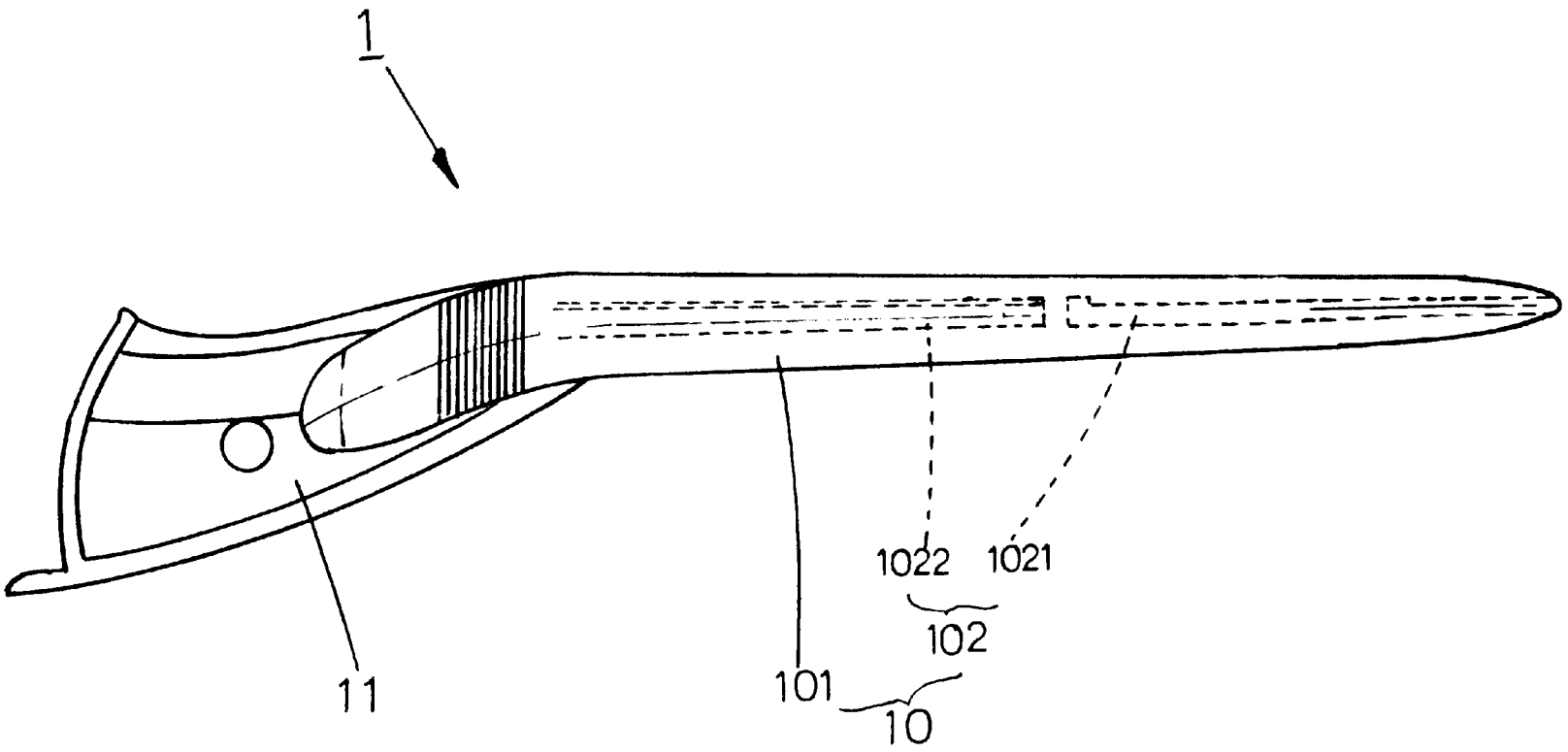
FIG. 4 is an orthographic drawing of the invention herein, as viewed from a lateral perspective.

Referring to FIG. 2, FIG. 3, and FIG. 4, the improved diving fins of the invention herein involves a straightforward enhancement of the longitudinal web section 102 and the fluke sections 101 disposed along the two sides of the web section 102 that structurally constitute the fin surface 10 of the fins 1. Specifically, a first channel $A_1$ is formed transversely across the approximate center portion of the longitudinal web section 102, with a second channel $A_2$ and a third channel $A_3$ then formed lengthwise from its two sides, the second and the third channels $A_2$ and $A_3$ proceeding along the lateral interior edge of the fluke sections 101 until their ends each extend to the two sides of the boot 11 and their opposite ends intersect the two ends of the first channel $A_1$ to form a single, contiguous U-shaped channel A that divides the web section 102 into a rigid first web surface 1021 and a flexile second web surface 1022. As shown in FIGS. 2 and 3, a reinforced rib 10221 is disposed on each of the longitudinal sides of the second web surface 1022. When the diver bends the knees or stretches the legs, the two reinforced ribs 10221 will be moved by the pressure of the current in the second web surface 1022 and the swinging motion of the second web surface 1022 will provide a supporting force that works with the rigid first web surface 1021 to give a kicking effect with a powerful push.

Figure 5:
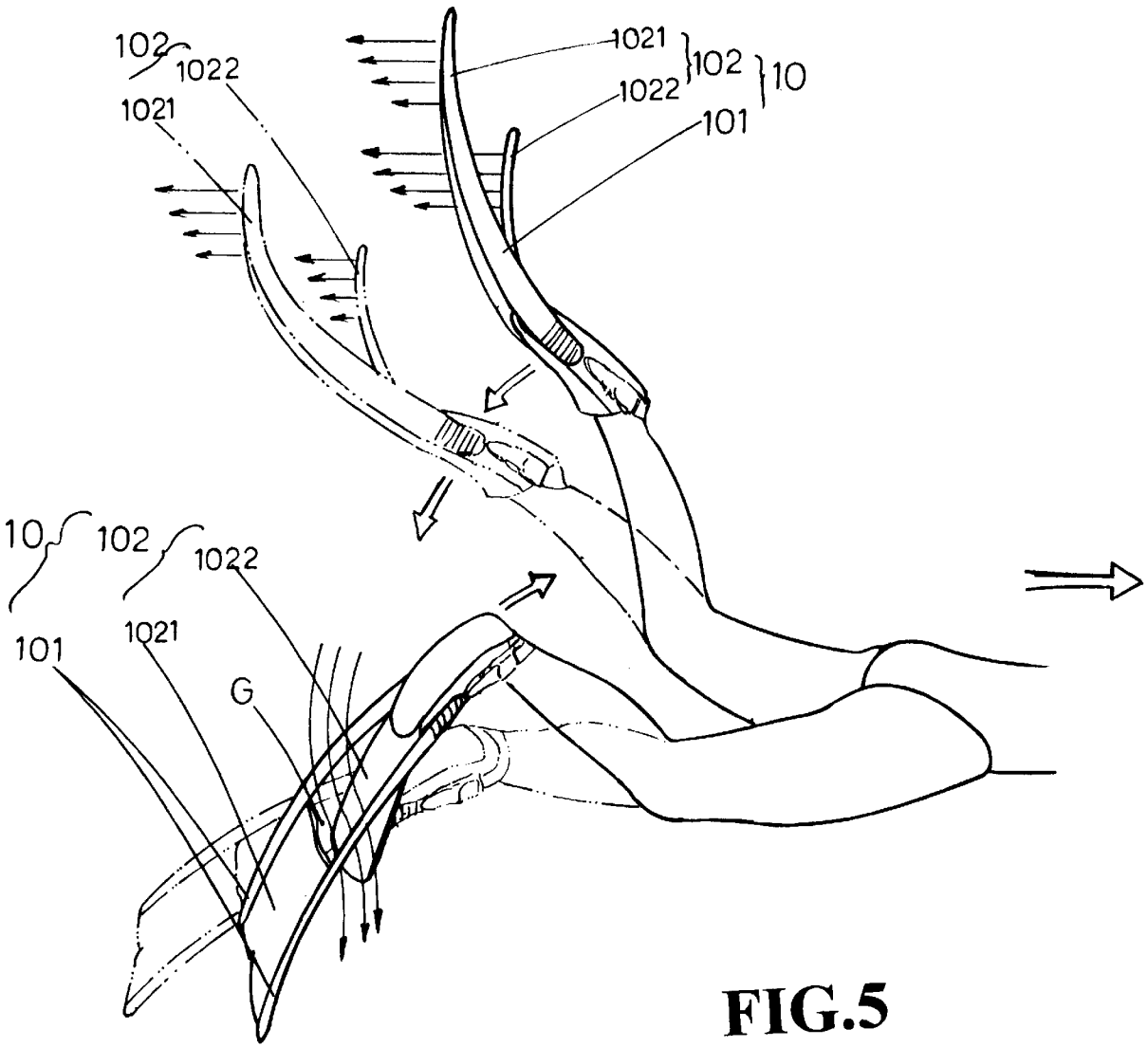
FIG. 5 is an isometric drawing that illustrates the articulation of the invention herein.

Referring to FIG. 5, when the diver articulates both legs rearward and downward for aquatic kicking by posterior extension, due to the flexing potential of the said second web surface 1022, it is automatically displaced forward by the force of water resistance and then reverts to a nearly perpendicular disposition as the rigidness of the first web surface 1021 follows in a coordinated action during the kicking sequence and, as such, the said first and second web surfaces 1021 and 1022 are alternately articulated into the nearly perpendicular disposition to respectively provide a maximum surface area of force application and thereby generate a larger magnitude of thrust. In other words, since the said second web surface 1022 is capable of automatically deviating forward during flutter kick execution and then coordinated into a nearly perpendicular state by the first web surface 1021 to achieve a larger surface area of force application—unlike the conventional web section that has a smaller surface area of force application and which is in a more inclined disposition during flutter kicking, the power articulated by legs of the diver leverages a reactive force (i.e., thrust) that is even greater than that conventional structure, thereby raising aquatic kicking efficiency and increasing diver speed; of course, since the said aquatic kicking efficiency is definitely higher, the kick rate of the diver is lower, thereby conserving physical strength and delaying the onset of fatigue.

Additionally, when the diver articulates both legs forward and upward preparatory to aquatic kicking by anterior bending, since the said second web surface 1022 is automatically displaced rearward by the force of water resistance and a diverting hole G provides for passage of water flow—unlike the conventional structure in which the entire longitudinal surface area of the web section produces viscous drag, the resistance of the said water flow is effectively reduced such that the forward movement of the legs articulated by the diver preparatory to aquatic kicking stroke requires less strength and is more relaxed.

Since the invention herein consists of the second web surface 1022 additionally disposed at the web section 102 that is capable of flexing and, furthermore, the web section 102 not only facilitates high aquatic kicking efficiency when both legs are articulated into posterior extension, but at the same time also provides for reduced water resistance that effectively saves strength when both legs are articulated into anterior bending, therefore, the fluke sections 101 disposed along the two sides of the web section 102 can be of a softer composition without a loss of support strength and consequently the said fluke sections 101 and the web section 102 constituting the fin surface 10 have a greater degree of pliability such that diving implementation emulates the agile and natural caudal fin movement of a fish and thereby achieves maximum flutter kicking efficiency.

In summation of the foregoing section, the improved diving fins of the invention herein are capable of providing for the actual needs and problems of divers even though its structure is not overly complex and unnecessarily detailed in operational concept and physical specifics and, furthermore, has not been observed among similar products now in use and, therefore, meet the patent application requirements of originality and progressiveness, the present is submitted to the examination committee for review and the granting of the commensurate patent rights.

What is claimed is:

1. Improved diving fins, comprising:

(a) a boot section;

(b) a fin surface extending from the boot section, the fin surface including a rigid first longitudinal web surface joined to the boot section by a pair of fluke sections respectively disposed on opposing sides of the first longitudinal web surface, and a flexile second web surface divided by a contiguous U-shaped channel, the U-shaped channel being formed by a first channel formed transversely across an approximate center portion of the fin surface between the fluke sections, with a second channel and a third channel respectively formed longitudinally from corresponding portions of the boot section along the fluke sections to the first channel; and, (c) a pair of reinforced ribs respectively disposed on opposing longitudinal sides of the second web surface, wherein the second web surface is displaceable by water forces in each of two opposing directions.

* * * * *